United States Patent [19]

Kamino et al.

[11] Patent Number: 4,991,998

[45] Date of Patent: Feb. 12, 1991

[54] MINE COOLING POWER RECOVERY SYSTEM

[75] Inventors: Yukishige Kamino, Tsuchiura; Makoto Saito, Ibaraki; Kenji Uchida, Kashiwa; Naoshi Furutani, Ibaraki, all of Japan; Ian Monroe, Johannesburg, South Africa

[73] Assignee: Hitachi, Ltd., Tokyo, Japan

[21] Appl. No.: 432,902

[22] Filed: Nov. 7, 1989

[30] Foreign Application Priority Data

Aug. 23, 1989 [JP] Japan ..... 1-215095

[51] Int. Cl.[5] ..... E02D 19/14

[52] U.S. Cl. ..... 405/130; 62/260; 165/45; 165/104.31

[58] Field of Search ..... 405/56, 130; 62/260; 165/104.31, 45; 299/16

[56] References Cited

U.S. PATENT DOCUMENTS

| | | | |
|---|---|---|---|
| 3,220,470 | 11/1965 | Balch | 405/130 X |
| 3,950,958 | 4/1976 | Loofbourow | 405/56 X |
| 4,750,333 | 6/1988 | Husain et al. | 62/260 X |

FOREIGN PATENT DOCUMENTS 820078 1/1982 South Africa .

*Primary Examiner*—Randolph A. Reese
*Assistant Examiner*—John A. Ricci
*Attorney, Agent, or Firm*—Antonelli, Terry, Stout & Kraus

[57] ABSTRACT

A mine cooling power recovery system wherein a low-pressure slurry pump for charging the mud slurry produced in a mine into a pressure changeover feed chamber is arranged in parallel to a warm water charging low-pressure pump and each of outlets of the two pumps has a changeover valve so that a single power recovery system pumps up both the mud slurry and a warm water out of the mine. A slurry sedimentation tank may be provided on the ground surface.

8 Claims, 5 Drawing Sheets

MINE COOLING POWER RECOVERY SYSTEM

BACKGROUND OF THE INVENTION

1. Field of the Invention

The present invention relates to a mine cooling power recovery system delivering a cold water or ice slurry for cooling mines, e.g. a gold mine and diamond mine and pumping a warm water or mud slurry produced in the mines up to the ground surface.

2. Description of the Related Art

Prior-art mine cooling processes have failed to clearly disclose a changeover between means for delivering a cold water from the ground surface to an underground mine and lifting a warm water produced in the mine up to the ground surface and means for lifting a mud slurry up to the ground surface. In addition, one prior-art mine cooling process employs a manometer with a contact for controlling opening and shutting operations of valves of a mine cooling system.

For example, South African patent No. 82/0078 is related with such mine cooling processes.

The prior-art mine cooling processes have failed to take into account a pumping up of the mud slurry produced when the cold water is scattered in the mine. Thus, a high-pressure pump for pumping the mud slurry out of the underground mine up to the ground surface and an associated high-pressure pipeline must be provided together with the mine cooling power recovery system.

In addition, the prior-art mine cooling processes employ a manometer with a contact for controlling opening and shutting operations of shut-off valves and of equalizing valves connected to opposite ends of a pressure changeover feed chamber. The prior-art mine cooling processes have failed to take into account a service life of the mine cooling power recovery system.

SUMMARY OF THE INVENTION

An object of the present invention is to provide a mine cooling power recovery system which reduces an equipment cost and a power cost in pumping up a mud slurry and increases the reliability of equipment.

In order to achieve the object of reducing the equipment cost, a low-pressure slurry pump for charging the mud slurry produced in a mine into a pressure changeover feed chamber is arranged in parallel to a warm water charging low-pressure pump and each of outlets of these pumps has a changeover valve so that a single power recovery system pumps up both the mud slurry and the warm water out of the mine.

A monitoring sensor for sensing an interface between the mud slurry and the warm water is provided on the ground surface in order to allow changeover valves to open to a huge ore-waste heap during a transportation of the mud slurry and to open to a warm water tank during a transportation of the warm water and to prevent the warm water from entering the huge ore-waste heap and the mud slurry from entering the warm water tank.

A pig charger is provided in order to eliminate a scale deposited on the inner surface of a pipeline which has delivered the mud slurry.

A durable service life noncontact sensor and a timer are used in order to achieve the object of increasing the reliability of a valve operation control apparatus.

A mud slurry sedimentation tank is provided on the ground surface in order to reduce a mine excavation cost.

In order to achieve the object of reducing a power cost in pumping up the mud slurry or warm water, a low-pressure pump for charging the warm water into a refrigerator is provided on the ground surface so that the head of warm water is used to recover a power.

When the warm water or mud slurry is transported, the changeover valves provided respectively at the outlets of the warm water charging low-pressure pump and the low-pressure slurry pump, and the changeover valve provided at the outlet of the ground surface of a pipeline of the mine cooling power recovery system are charged over so that the operation of the mine cooling power recovery system can be continued.

A fluid density variation monitoring sensor provided near the outlet of the ground surface of the pipeline senses the interface between the mud slurry and warm water and timely controls the changeover valves provided at the outlet of the ground surface of the pipeline so that the warm water is prevented from entering the huge ore-waste heap and the mud slurry is prevented from entering the warm water tank.

Passing a pig having an outer diameter essentially equal to the bore diameter of a transportation pipeline through the transportation pipeline which has transported the mud slurry can eliminate a scale deposited on the inner surfaces of pipes of the transportation pipeline.

In addition, since a timer and noncontact sensor having a durability equal to or more than $10^7$ cycles are employed in a valve opening and closing operation control device, the service lives of the timer and noncontact sensor are prominently longer than that of the prior-art manometer with the contact (having a $10^4$-cycle service life).

DESCRIPTION OF THE PREFERRED EMBODIMENTS

Figure 1:
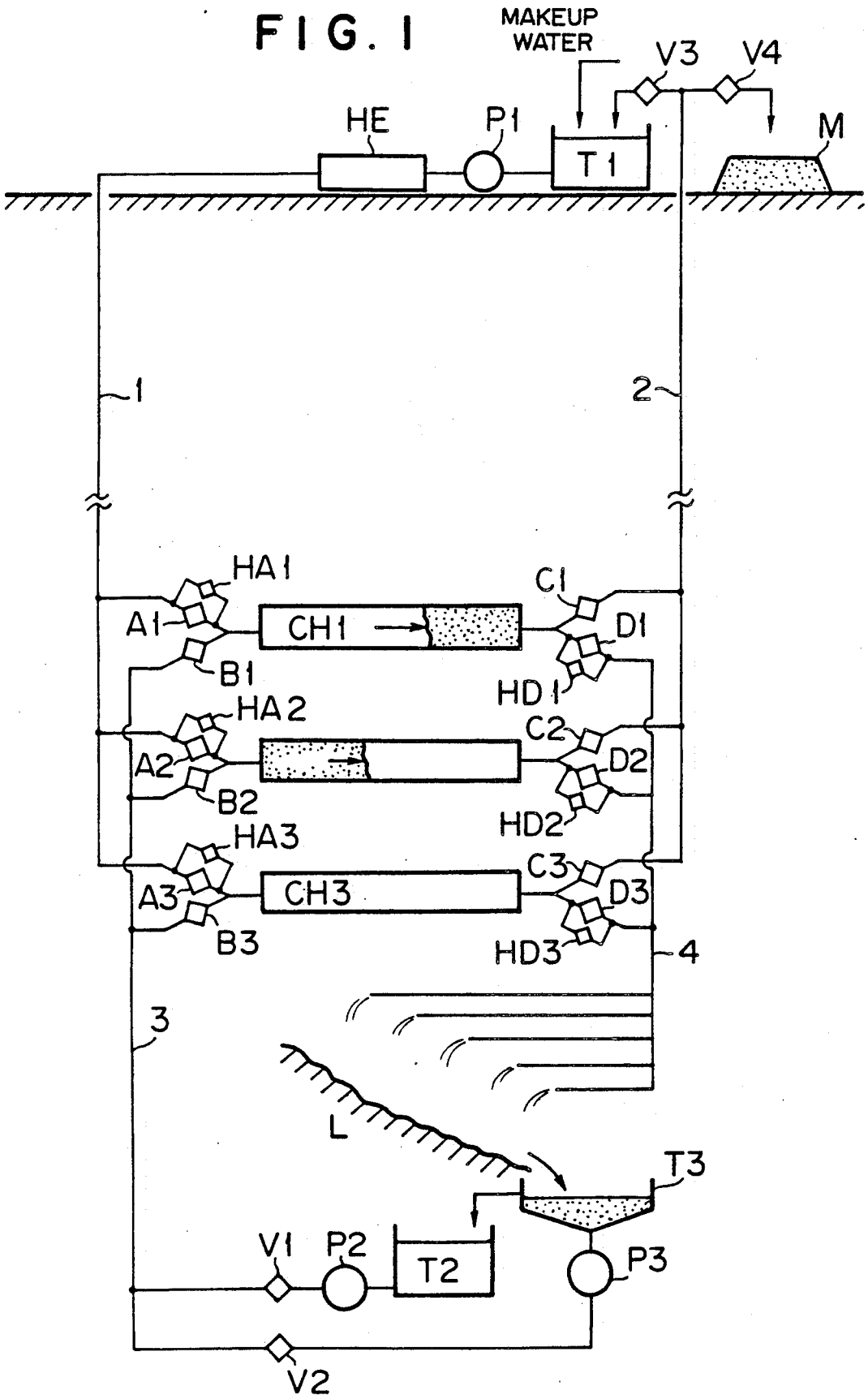
FIG. 1 is a block diagram of a mine cooling power recovery system of a first embodiment of the present invention.

As shown in FIG. 1 a warm water tank T1 is installed on the ground surface, with a warm water pump P1 delivering a warm water out of the warm water tank T1 through a refrigerator HE into an underground mine. The warm water passing through the refrigerator HE changes to a cold water which is delivered through a high-pressure pipeline extending from the ground surface to the mine and through a valve A1 provided in the mine to a pressure changeover feed chamber CH1. When the cold water is delivered to the feed chamber CH1, a valve C1 is open and valves B1 and D1 and equalizing valves HA1 and HD1 are closed.

When the cold water has filled the feed chamber CH1, the valves A1 and C1 are closed. Then, the valve HD1 is opened to change the pressure within the feed chamber CH1 from a high pressure to a low pressure and then is closed.

Then, the valves B1 and D1 are opened and a low-pressure warm water pump P2 delivers a warm water from a warm water tank T2 through a changeover valve V1, a low-pressure pipeline 3 and the valve B1 to the feed chamber CH1 to fill the feed chamber CH1 with the warm water. During this time, the warm water urges the cold water out of the feed chamber CH1 through the valve D1. The cold water is fed to a working face or working place L through a low-pressure pipeline 4.

Then, when the warm water has filled the feed chamber CH1, the valves B1 and D1 are closed. Then, the valve HA1 is opened to change the pressure within the feed chamber CH1 over from a low pressure to a high pressure and then is closed.

Then, the valves A1 and C1 are opened to allow the cold water to be delivered from the ground surface to the feed chamber CH1 as described above. During this time, the warm water is urged out of the feed chamber CH through the valve C1 and is pumped up into the warm water tank T1 through a high-pressure pipeline 2 and a changeover valve V3.

The cold water which has passed through a low-pressure pipeline 4 is scattered over the working face or working place L and eliminates heat from heat loads of e.g. the atmosphere, machines and a head way) of the working face L, so that the cold water is changed into the warm water.

Thus, the scattered cold water dissolves a clay content of a head way rock wall to become a warm mud slurry. The warm mud slurry is separated into a mud content and a warm water content in a slurry sedimentation tank T3 and only a warm water of supernatant is delivered to the warm water tank T2. The low-pressure warm water pump P2 delivers the warm water of supernatant to feed chambers CH in the manner as described above.

The low-pressure slurry pump P3 changes the mud slurry which has sedimented in the sedimentation tank T3 into the feed chamber CH1 through the changeover valve V2 and through the low-pressure pipeline 3 and the valve B1 as in the case of the warm water. During this time, the changeover valve V1 is closed and the low-pressure warm water pump P2 is stopped.

Thus, the operation principle by which the cold water urges the low-pressure mud slurry which has filled the feed chamber CH1 into the high pressure pipeline 2 is the same as the operation principle of pumping up the warm water as described above.

Figure 2:
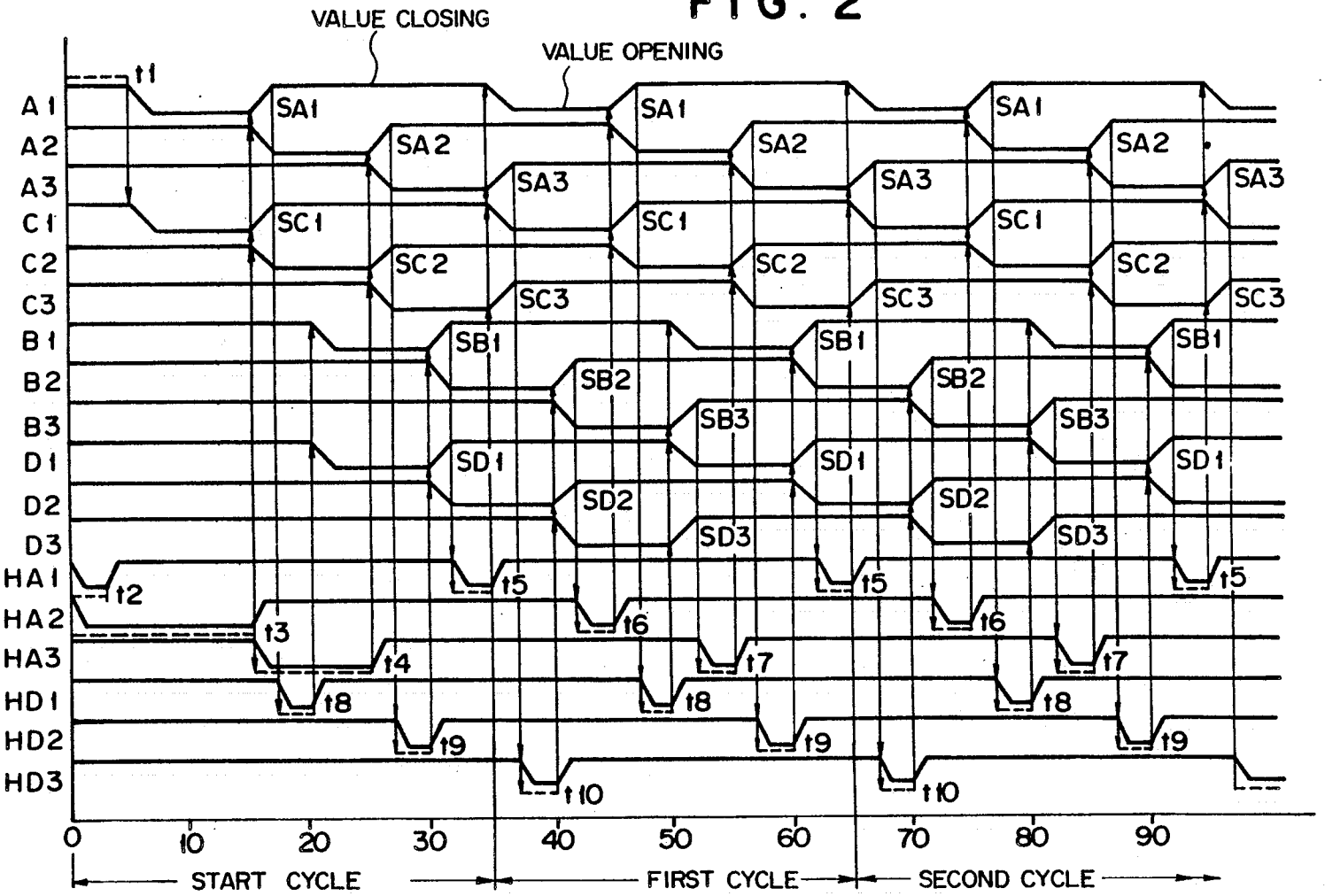
FIG. 2 is a diagram of control time schedules of the valves.

FIG. 2 illustrates a method of controlling the valves connected to opposite ends of each of the feed chambers CH. Proximity switches detect open and closed positions of the valves and timers produce opening and closing timing signals for the valves. Thus, the first embodiment of the present invention has a greatly increased reliability than the prior-art technique in which a pressure switch (i.e. manometer with a contact) controls valves in response to a pressure within each of the feed chambers CH.

As described above, the first embodiment of FIG. 1 employs the power recovery pump (e.g. a hydrohoist) installed in the underground mine, which pump can utilize a potential energy of the cold water descending from the ground surface for pumping the warm water and mud slurry from the underground mine up to the ground surface, so that the mud slurry pump is not required to generate a high pressure and a decrease of the operating pressure of the mud slurry pump can reduce an initial cost, maintenance cost and demand power of the mud slurry pump.

In addition, the high-pressure piping for pumping the warm water up from the underground mine to the ground surface can also serve as the mud slurry transportation piping, so that an initial cost of the high-pressure piping, e.g. material cost, civil engineering work cost and installation cost and a maintenance cost of the high-pressure pipeline can be reduced.

In addition, since the durable noncontact sensors and timers control the opening and closing operations of the valves connected to the opposite ends of each of the feed chambers, the reliability of the mine cooling power recovery system of the first embodiment is increased.

The mud slurry which has been delivered to the ground surface must be discharged through the changeover valve V4 to a huge ore-waste heap M but must not enter the warm water tank T1, because a refrigerator HE will be damaged by the mud slurry if the mud slurry is delivered to the warm water tank T1 and then the warm water pump P1 delivers the mud slurry out of the warm water tank T1 to the refrigerator HE.

Figure 3:
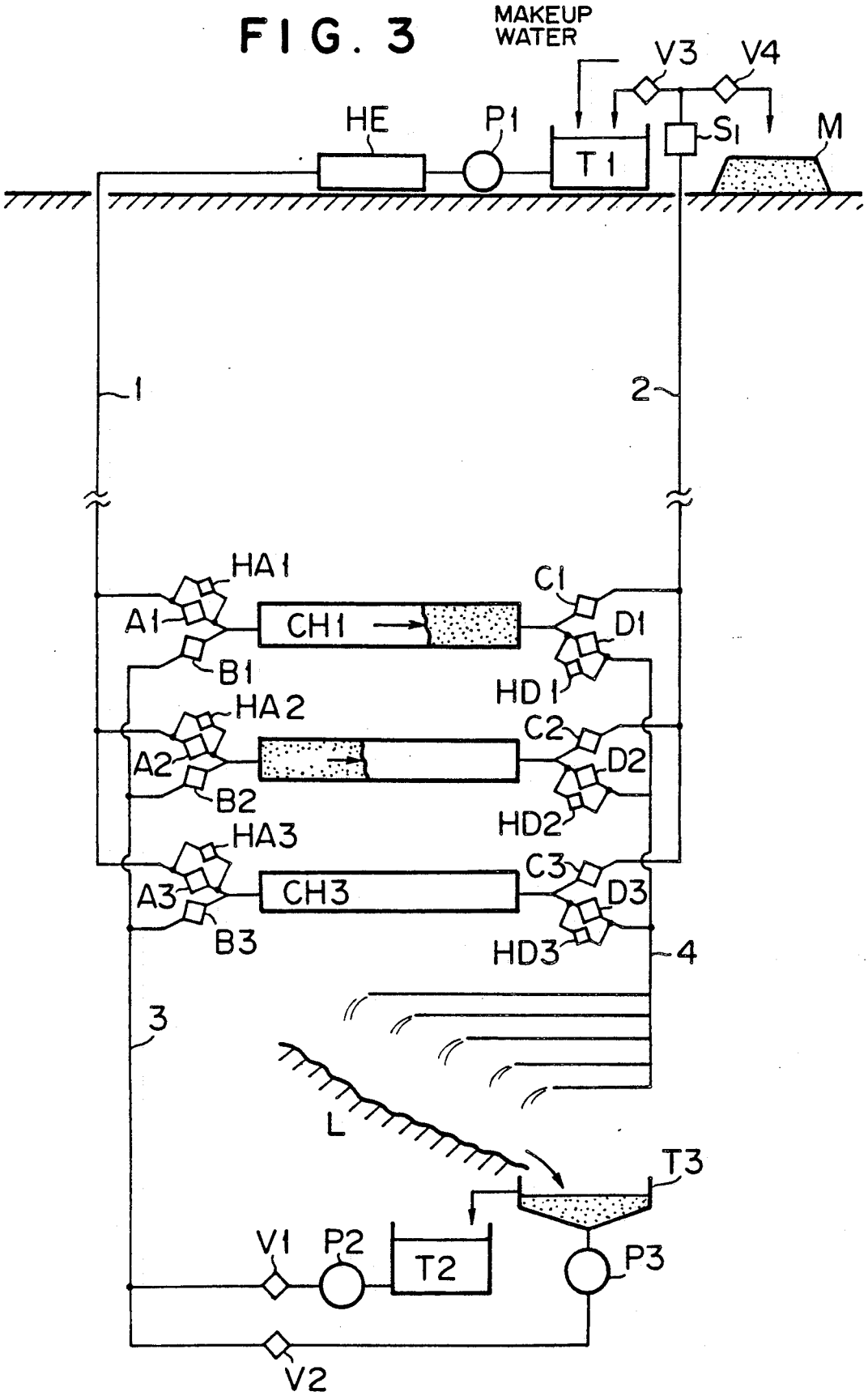
FIG. 3 is a block diagram of a mine cooling power recovery system of a second embodiment of the present invention.

The slurry pump P3 delivers the mud slurry out of the slurry sedimentation tank T3 through the high-pressure pipeline 2 and changeover valve V4 to the huge ore-waste heap M as in the first embodiment of FIG. 1. After a predetermined amount of the mud slurry is delivered, the changeover valve V2 is closed and the operation of the slurry pump P3 is stopped. Then, the warm water pump P2 is operated and the changeover valve V1 is opened, so that the warm water is pumped out of the warm water tank T2 through the low-pressure pipeline 3 up to the surface. Thus, when the operation of the mine cooling power recovery system is changed over from a slurry transportation mode to a warm water transportation mode, the changeover valve V4 provided at the ground surface is turned off and concurrently the changeover valve V3 provided at the ground surface is turned on to allow the warm water to enter the warm water tank T1. If the mud slurry enters the warm water tank T1, the mud slurry produces damages of an abrasion, clogging and/or reduction in a heat exchanger effectiveness of the refrigerator HE. Thus, the changeover timings of the changeover valves V3 and V4 must be adequately controlled so that the mu-d slurry will not enter the warm water tank T1. As shown in FIG. 3, in accordance with the second embodiment of the present invention, a sensor $S_1$ (e.g. a densitometer or photosensor) which is provided at an outlet of the ground surface of the high-pressure pipeline 2 and which detects an interface between the mud slurry and warm water in order to automatically control the changeover timings of the changeover valves V3 and V4.

As described above, the provision of the sensor $S_1$ for detecting the interface between the mud slurry and warm water provides a control system by which the mud slurry will not enter the refrigerator HE when the operation of the mine cooling power recovery system of the second embodiment is changed over from the mud slurry transportation mode to the warm water transportation mode.

Figure 4:
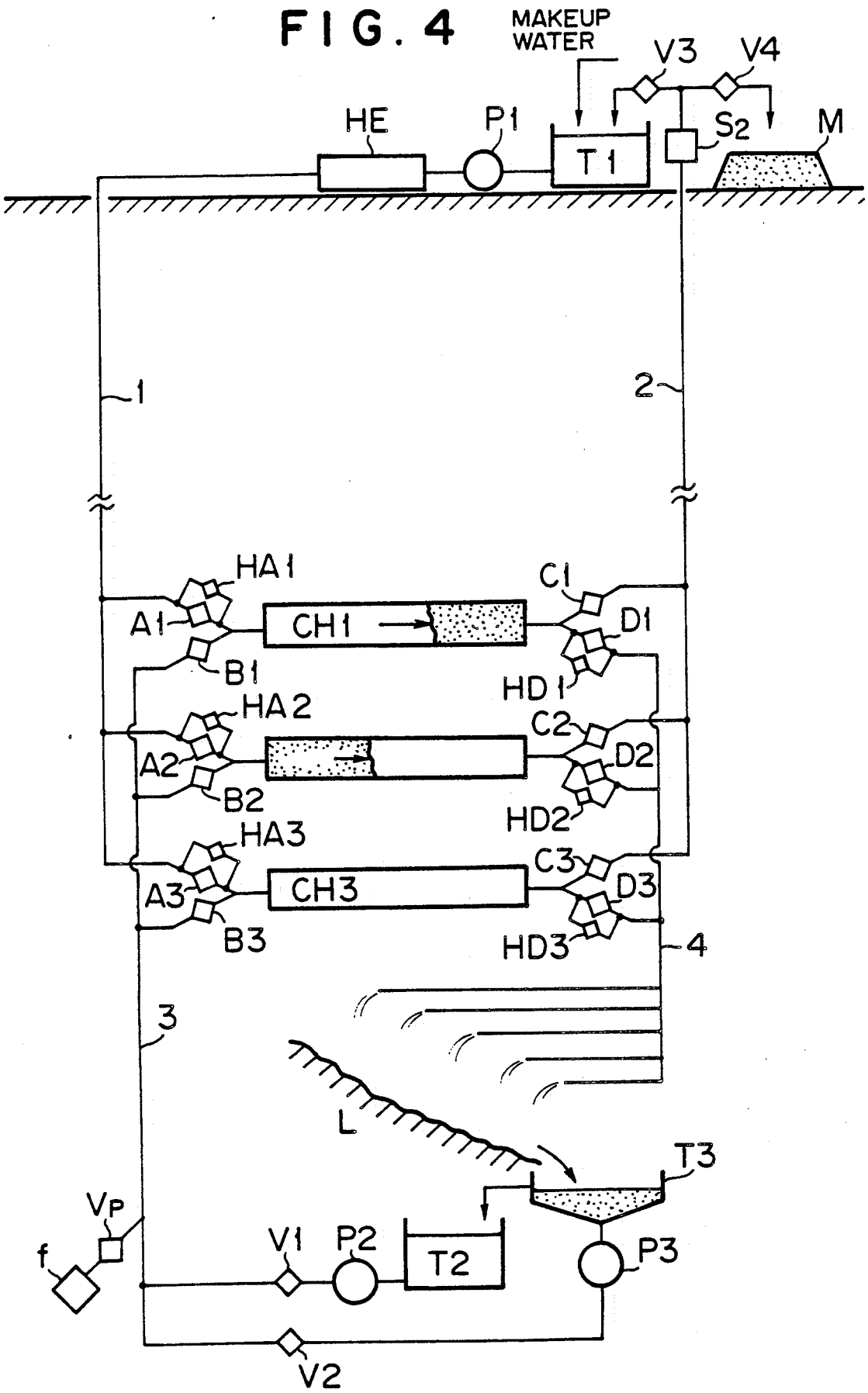
FIG. 4 is a block diagram of a mine cooling power recovery system of a third embodiment of the present invention.

In order to prevent the mud slurry from sticking on a pipe inner surface when the mud slurry passes through the pipelines from contaminating the warm water and from demanding the refrigerator HE during the warm water transportation mode, as shown in FIG. 4, a pig charger f charges a pig into the low-pressure pipeline 3 and the warm water discharged by the warm water pump P2 moves the pig. The pig has a diameter slightly smaller than the bore diameter of each of the pipelines and can scrape the mud slurry from the inner surface of each of the pipelines. When the pig approaches the outlet of the ground surface of the high-pressure pipeline 2, a pig sensor $S_2$ detects the pig and outputs signals to the changeover valves $V_3$ and $V_4$ so that the changeover valve V4 is turned off and concurrently the changeover valve V3 is turned on after the pig passes through the changeover valve V4 to the huge ore-waste heap M.

As described above, in the embodiment of FIG. 4 the pig charge f can eliminate a sticking of the mud slurry the inner surface of each of the pipelines which have transported the mud slurry.

Figure 5:
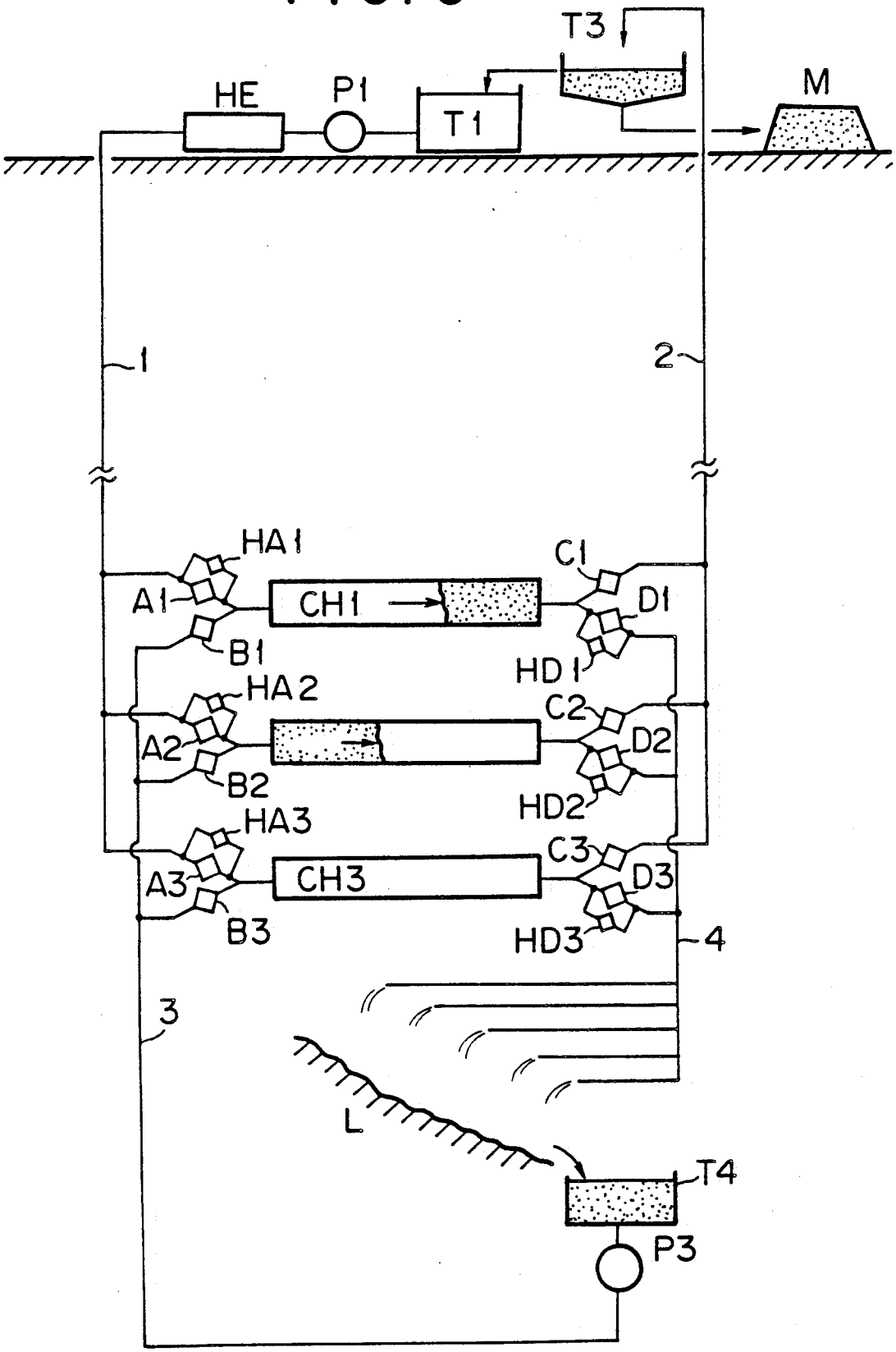
FIG. 5 is a block diagram of a mine cooling power recovery system of a fourth embodiment of the present invention.

The embodiment of FIG. 5 differs from the other embodiments in that the slurry sedimentation tank T3 is installed on the ground surface. Thus, a need for an excavation space for an underground slurry sedimentation tank is eliminated and a single pipeline serves as both of a warm water transportation system and a mud slurry transportation system so that simplify the mine cooling power recovery system of the present invention is simplified.

The present invention is also applicable to a system in which the low-pressure pipelines 3 and 4 are connected to each other through e.g. an air conditioning heat load and in which the warm water is pumped up to the ground surface, in addition to the above-described embodiments.

What is claimed is:

1. In a system comprising a refrigerator provided on the ground surface, a pressure changeover feed chamber and a heat load both provided in an underground mine, a cold water feed pipeline extending from the ground surface to the underground mine, a warm water feed pipeline extending from the underground mine to the ground surface, a mine cooling power recovery system including a first warm water charging pump for delivering a warm water to the refrigerator on the ground surface, a low-pressure slurry pump arranged in the underground mine in parallel to a second warm water charging pump which delivers the warm water to the pressure changeover feed pump, an outlet of the second warm water charging pump provided in the underground mine having a warm water changeover valve, an outlet of the low-pressure slurry pump provided in the underground mine having a slurry changeover valve, a discharge line of each of the changeover valves is connected to a warm water charging low-pressure pipeline for delivering the warm water to the pressure changeover feed chamber, an outlet of a high pressure pipeline for lifting the warm water out of the underground mine to the ground surface is connected to warm water feed pipe line extending to a warm water tank and to a slurry feed pipeline extending to a ore-waste heap, the warm water feed pipeline has a warm water changeover valve, and the slurry feed pipeline has a slurry changeover valve.

2. A mine cooling power recovery system as recited in claim 1, wherein the high-pressure pipeline for lifting the warm water out of the underground mine up to the ground surface has a fluid density variation monitoring sensor for a fluid passing through the high-pressure pipeline and means for controlling opening and shutting operations of the warm water changeover valve and slurry changeover valve in response to signals generated by the fluid density variation monitoring sensor.

3. A mine cooling power recovery system as recited in claim 2, wherein the fluid density change monitoring sensor includes one a densitometer, photosensor and pig sensor.

4. A mine cooling power recovery system as recited in claim 1, wherein each of shut-off valves and equalizing valves connected to opposite ends of the pressure changeover feed chamber has a valve opening and shutting detection sensor, and means for controlling an opening and a shutting of each of the shut-off valves and equalizing valves connected to the opposite ends of the pressure changeover feed chamber is provided.

5. A mine cooling power recovery system as recited in claim 4, wherein the control means includes one of a timer and a noncontact sensor.

6. In a system comprising a refrigerator provided on the ground surface, a pressure changeover feed chamber and a heat load both provided in an underground mine, a cold water feed pipeline extending from the surface to an underground, and a warm water feed pipeline extending from the underground mine to the ground surface, a mine cooling power recovery system characterized in that a warm water charging low-pressure pump for delivering a warm water to the refrigerator is provided on the ground surface, both a slurry pump for delivering a mud slurry to the pressure changeover feed chamber and a slurry tank are provided in the underground mine, and a mud slurry sedimentation tank is provided on the ground surface.

7. A mine cooling power recovery system as recited in claim 6, wherein each of shut-off valves and equalizing valves connected to opposite ends of the pressure changeover feed chamber has a valve opening and shutting detection sensor and means for controlling an opening and a shutting of each of the valves.

8. In a system comprising a refrigerator, a pressure changeover feed chamber and a heat load both provided below the refrigerator, a cold water feed pipeline extending from the refrigerator to the pressure changeover feed chamber and to the heat load, a warm water feed pipeline extending to the pressure changeover feed chamber and to the heat load, a mine cooling power recovery system including a first warm water charging low-pressure pump connected to the refrigerator, a low-pressure slurry pump arranged in parallel to a second warm water charging low-pressure pump which delivers a warm water to the pressure changeover chamber, an outlet of the second warm water charging low-pressure pump has a warm water changeover valve, an outlet of the low-pressure slurry pump has a mud slurry change-over valve, discharge lines of both the changeover valves are connected to a warm water charging low-pressure pump line for delivering the warm water to the pressure changeover feed chamber, an outlet of a high-pressure pipeline for lifting the warm water out of the underground mine to the ground surface is connected to a warm water feed pipeline extending to the warm water tank and to a slurry feed pipeline extending to an ore-waste heap, the warm water pipeline has a warm water tank has a warm water changeover valve, and the slurry feed pipeline has a slurry changeover valve.

* * * * *